United States Patent [19]

Watanabe

[11] 4,425,528

[45] Jan. 10, 1984

[54] COLOR PICTURE TUBES AND METHOD OF MANUFACTURING THE SAME

[75] Inventor: Naomitsu Watanabe, Mobara, Japan

[73] Assignee: Hitachi, Ltd., Tokyo, Japan

[21] Appl. No.: 261,497

[22] Filed: May 7, 1981

[30] Foreign Application Priority Data

May 16, 1980 [JP] Japan ..... 55-64126

[51] Int. Cl.[3] ..... H01J 29/10

[52] U.S. Cl. ..... 313/466; 313/473; 313/474

[58] Field of Search ..... 313/466, 470, 473, 474; 427/68

[56] References Cited

U.S. PATENT DOCUMENTS

| | | | |
|---|---|---|---|
| 3,114,065 | 12/1963 | Kaplan | 313/472 |
| 3,875,449 | 4/1975 | Byler et al. | 313/466 |
| 3,886,394 | 5/1975 | Lipp | 313/473 |
| 4,331,752 | 5/1982 | Yokomizo et al. | 427/68 |

*Primary Examiner*—Palmer C. Demeo
*Assistant Examiner*—Sandra L. O'Shea
*Attorney, Agent, or Firm*—Charles E. Pfund

[57] ABSTRACT

Red and blue light emitting members constituting a three color fluorescent screen of a color picture tube comprise a combination of a red phosphor, a blue phosphor and a filter substance of a color different from colors of lights emitted by the red and blue phosphors. As the filter substance is used a purple pigment, for instance.

3 Claims, 4 Drawing Figures

COLOR PICTURE TUBES AND METHOD OF MANUFACTURING THE SAME

BACKGROUND OF THE INVENTION

This invention relates to a color picture tube, more particularly three color phosphor films formed on the inner surface of the panel or face plate of the tube, and method of manufacturing the color picture tube.

Generally, a color picture tube is constituted by a panel, a funnel and a neck and dots or stripes of phosphors for emanating red, green and blue colors are disposed on the inner surface of the panel with a predetermined positional relationship. In a recent color picture tube, for the purpose of providing an excellent contrast under bright room light, color filters are provided for respective layers of the red, green and blue phosphors. Such color filters should have such characteristics that they selectively transmit light rays emanated by respective color phosphors without attenuating these light rays as far as possible and that they selectively absorb external light so as to greatly decrease the quantity of external light reflected by the surface of the fluorescent screen thereby improving contrast.

These color filters are generally prepared by the following three methods. According to a first method, as disclosed in U.S. Pat. No. 3,114,065, for example, layers of red, green and blue filter substances corresponding to red, green and blue phosphor layers respectively are interposed between the phosphor screen surface and the inner surface of the glass panel. In this case, the filter substances used a mixture of polyvinyl alcohol, ammonium dichromate and a filter substance, or a mixture of a powder of frit glass and a filter substance.

According to a second method, as disclosed in U.S. Pat. No. 3,886,394, fine particles of filter substances corresponding to respective colors emanated by respective phosphors are deposited on the surfaces of phosphor particles so as to form red, green, and blue filter layers by using these pigmented phosphors.

According to a third method, as disclosed in U.S. Pat. No. 3,114,065 a suspension comprising a mixture of respective phosphors and filter substances is used to cause red, green and blue phosphor layers formed on the glass panel to contain corresponding filter substances thereby forming red, green and blue filter layers.

Where filter layers are formed with one of these three methods, contradictory characteristics of lowering the brightness caused by the intervention of the filter substances and improvement of the contrast degrade overall quality.

With the first method, since the filter layers are disposed between the inner surface of the panel and the phosphor layers the energy of the election emitted by election guns is not attenuated by the filter substances so that the brightness of the light emanated by the phosphors is high. Moreover, as the external light transmitting through the panel is absorbed by the filter substances, contrast can be improved.

However, as it is necessary to form filter layers at predetermined positions of the phosphors for respective colors before forming the phosphor layers the number of process steps increases.

The second method is used widely, and according to this method, so called pigmented phosphors are used in which fine powders of filter substances of respective colors are coated on the surface of phosphor particles by using such binder as gelatin or the like. For the red phosphor, iron oxide or cadmium-sulpho-selenide which are red pigments are used as the filter substance, and cobalt aluminate, or ultramarine which are blue pigments are used for the blue phosphor. According to this method, however, a pigment of one color is incorporated into the phosphor layers of other colors during the step of manufacturing the phosphor surface. Thus for example, red pigment particles penetrate into the blue phosphor layer, and such red pigment absorbs the light emitted by the blue phosphor to greatly decrease the brightness of the blue color.

Although the third method is used to certain extent, since the filter substances are separated from the phosphors, a large quantity of the filter substances in the form of fine particles is incorporated into the phosphor layers of the other colors, thus greatly decreasing the brightness. To eliminate this problem, it has been proposed to interpose a filter substance between one of the red, green and blue phosphor layers and the face plate by first coating a suspension of the phosphor of that color and the pigment. With this method, however, since the filter substance is applied onto the phosphor layer of one color, it is impossible to sufficiently decrease the quantity of external light reflected by the screen surface thus failing to improve the contrast.

FIG. 1 shows the spectrum reflection ratio characteristic of a red filter substance applied to the red phosphor color with a prior art method in which curve a shows the characteristic of cadmium-sulpho-selenide and curve b that of iron oxide. In FIG. 1, the ordinate represents the reflection ratio by taking that of a magnesium oxide, reflection plate of 100%. In the main wavelength range of 610 though 630 nm of the red phosphor, cadmium-sulpho-selenide and red iron manifest a relatively high reflection ratio thus transmitting light emanated from the red phosphor without any appreciable attenuation.

On the other hand, in the blue to green wavelength range of 400 to 550 nm, among of the light rays coming from outside of the screen, light rays in the blue to green wavelength range are selectively absorbed thereby improving the contrast of the screen of the color picture tube.

In the same manner, FIG. 2 shows the spectrum reflection ratio characteristics of a blue filter substance heretobefore applied to the blue phosphor layer in which curve c shows the characteristic of cobalt aluminate and curve d that of ultramarine. The cobalt aluminate and ultramarine manifest relatively high reflection ratio in the main wavelength range of from 420 to 480 nm of the blue phosphor, whereas they show a low reflection rate in the green to red wavelength range of from 530 to 650 nm.

Where a color picture tube is manufactured by using the above described filter substances it is impossible to prevent admixing of a filter substance of one color with the phosphor layers of the other colors at the time of forming a fluorescent screen which degrades the brightness. For example, when the red filter substance shown in FIG. 1 is incorporated into the blue phosphor layer, the red filter substance would absorb the blue color light emanated from the blue phosphor so that blue color brightness decreases greatly. Also when the blue filter substance shown in FIG. 2 enters into the red phosphor layer, the blue filter substance would absorb the red color light emanated by the red phosphor thereby decreasing the red color brightness.

SUMMARY OF THE INVENTION

Accordingly, it is the principal object of this invention to provide a color picture tube provided with a three color phosphor film on the inner surface of the panel which can improve the contrast and decrease degration of the brightness caused by the intervention of filter substances.

Another object of this invention is to provide an improved method of manufacturing a color picture tube with a lesser number of process steps than the prior art method.

To accomplish these objects we have reexamined the fact that a red filter substance has been applied to a red color phosphor layer and that a blue filter substance has been applied to a blue phosphor film and investigated various filter substances. As a consequence, we have found that the most important point of the spectrum reflection ratio of the filter substance is that the reflection ratio should be small near 550 nm (520 nm to 580 nm), and that although the reflection ratio in the ranges of from 400 to 500 nm and of from 600 to 700 nm is large, satisfactory improvement of the contrast can be noted.

According to one aspect of this invention there is provided a color picture tube provided with a three color fluorescent screen comprising phosphors applied to predetermined portions of an inner surface of a panel of the tube for emitting red, green and blue color lights, and a filter substance combined with at least one of the red and blue phosphors and coated on the inner surface of the panel, the filter substance having a color different from colors of light emitted by a combination of the filter substance and at least one of the red and blue phosphors.

Another aspect of this invention provides a method of manufacturing a color picture tube of the type provided with a three color fluorescent screen formed by coating an inner surface of a panel of the tube with phosphors respectively emitting lights of red, green and blue colors and a filter substance, the method comprising the steps of applying combinations of a filter substance and phosphors respectively emanating red and blue colors onto predetermined portions of the inner surface of the panel, the filter substance having a color different from colors of lights emitted by combinations of the substance and the red and blue phosphors, and then applying a green phosphor onto the other predetermined portion of the inner surface of the panel.

According to a modification there is provided a method of manufacturing a color picture tube provided with a three color fluorescent screen formed by coating an inner surface of a panel of the tube with phosphors respectively emitting lights of green and blue colors, and a filter substance, the method comprising the steps of applying a film of photosensitive resin containing a diazonium salt as a major component onto the inner surface of the panel, exposing to light portions of the applied film to be applied later with red and blue phosphors, applying combination of the red, green and blue phosphors and a filter substance having a color different from colors of the lights emitted by the respective phosphors, exposing to light a portion of the film to be applied later with the green phosphor, and applying the green phosphor onto the lastly exposed portion.

DESCRIPTION OF THE PREFERRED EMBODIMENTS

Figure 1:
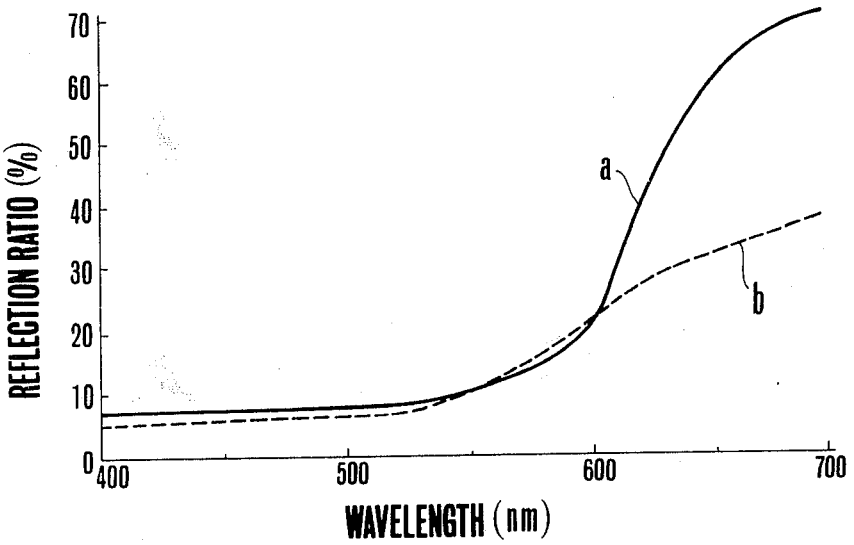
FIG. 1 PRIOR ART
FIG. 1 shows a spectrum reflection ratio characteristic of a red pigment, one of the filter substances utilized in combination with three color phosphor films of a prior art color picture tube.
Figure 2:
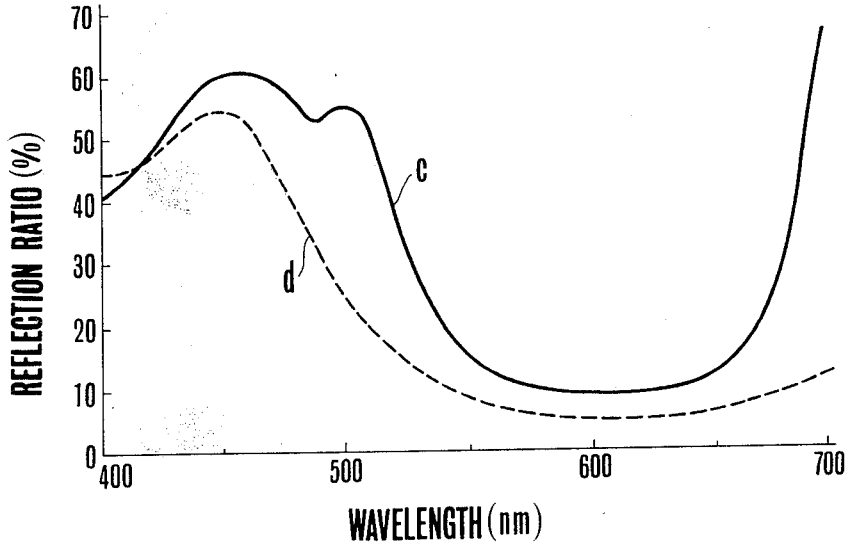
FIG. 2 PRIOR ART
FIG. 2 shows the spectrum reflection ratio so characteristic of a prior art blue pigment.
Figure 3:
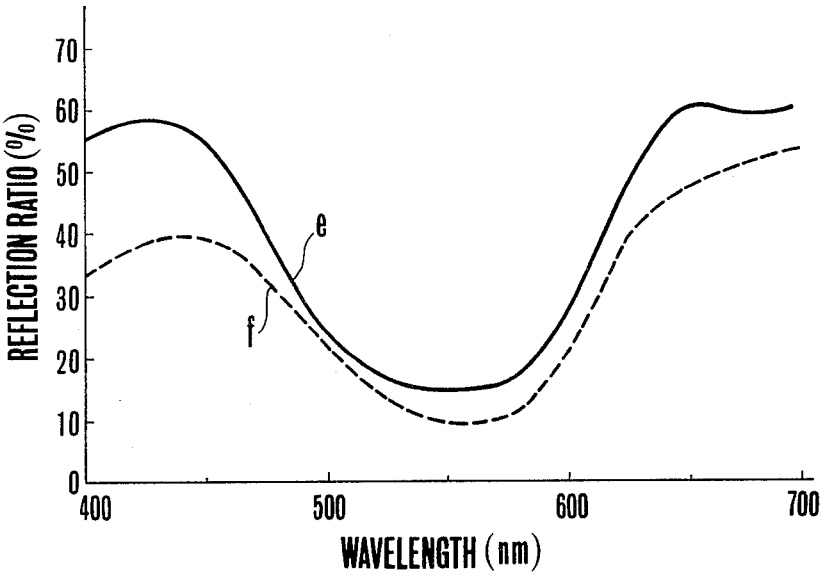
FIG. 3 shows a spectrum reflection ratio characteristic of a purple pigment, one of the filter substances utilized in combination with three color phosphor films of a color picture tube embodying the invention.

As above described, according to this invention a filter substance is applied to one or both of red and blue phosphor layers, the filter substance having a color different from those emanated from the phosphor layers to obtain excellent brightness and contrast characteristics. Preferably, the spectrum reflection ratios of the filter substances utilized in this invention at wavelength at 450 nm and 620 nm should be twice or more of that at a wavelength of 550 nm. With a reflection ratio of less than 2, the brightness of the blue and or red phosphors decreases greatly so that it is difficult to efficiently improve the contrast. FIG. 3 shows one example of the spectrum reflection ratio characteristics of filter substances utilized in this invention, in which curve e shows the characteristic of a purple (cobalt violet) pigment and curve f that is purple (manganese violet) pigment. It should be understood that the filter substance of this invention is not limited to these two materials.

To have better understanding of the present invention the following examples are given.

EXAMPLE 1

Figure 4:
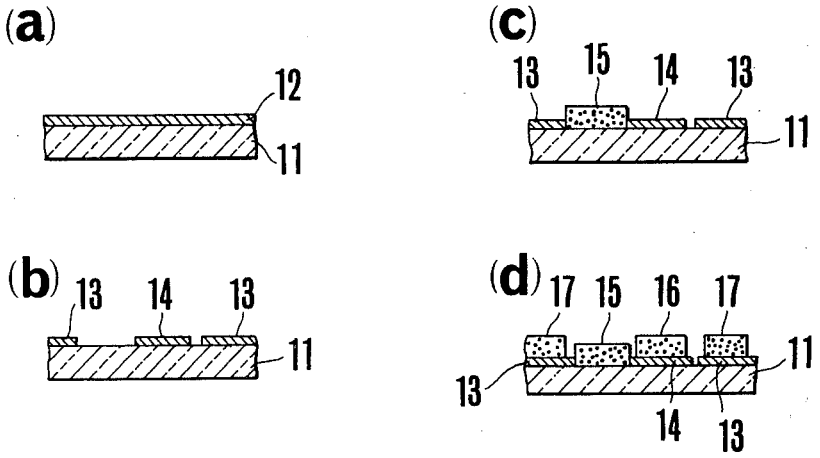
FIGS. 4*a* through 4*d* are sectional views showing one example of the steps of the method of manufacturing a fluorescent screen utilized in a color picture tube embodying the invention.

A suspension was prepared containing 2% by weight of cobalt violet, 2% by weight of polyvinyl alcohol (solid constituent), 2% by weight of ammonium bichromate and 95.8% by weight of water and this suspension was applied onto the inner surface of a panel 11 with rotary coating technique to form a thin and uniform pigment layer 12 as shown in FIG. 4*a*. After drying the purple pigment layer 12 thus formed, the portions thereof at positions where blue and red phosphor patterns are to be formed later were exposed to light from such light source as a mercury lamp through a shadow mask. Thereafter, not exposed portios were dissolved off by warm water development process to form purple pigment layers 13 and 14 at desired positions. Then, as shown in FIG. 4(*b*) a green phosphor suspension was uniformly coated to a thin thickness with rotary coating technique on the surface of the panel. After drying, the applied film was exposed to ultraviolet rays through the shadow mask and then not exposed portions were disolved off with warm water development technique to form a desired green phosphor layer 15 as shown in FIG. 4(*c*).

Thereafter, a blue phosphor layer 16 and a red phosphor layer 17 were prepared in the same manner as the green phosphor layer as shown in FIG. 4(*d*).

It was found that a color picture tube prepared in a manner described above has much higher contrast than a tube not formed with any pigment layer. The method of this invention is characterized in that since a purple pigment is used it is possible to simultaneously form, with only one pigment coating step, pigment layers on the portions of the inner surface of the panel corresponding to blue and red phosphor layers, thereby decreasing the number of steps.

EXAMPLE 2

A blue phosphor suspension containing 30% by weight of a pigmented phosphor formed by coating blue phosphor with 0.8% by weight based on the weight of the blue phosphor of manganese violet with gelatin, 2.2% by weight of polyvinyl alcohol, 0.2% by weight of ammonium bichromate, 0.1% by weight of a surfactant and 67.5% by weight of water was coated onto the inner surface of a panel formed with a black paint layer that is so-called black matrix layer of a predetermined pattern. After drying, the coated blue phosphor was exposed to ultraviolet rays through a shadow mask and then not dissolved portions were dissolved off by warm water development technique to obtain a desired blue phosphor layer coated with the purple pigment. Then a red phosphor suspension coated with a purple pigment having a composition similar to that described above except that the phosphor was of red color was prepared, and this suspension was used to form a red phosphor layer coated with the purple pigment in the same manner as the blue phosphor layer described above. Thereafter a green phosphor layer of a predetermined pattern was formed.

The contrast of a color picture tube thus manufactured was much higher than that of a conventional color picture tube not using the pigment of this invention. Thus, the method of this invention is characterized in that since the purple pigment is used in common for the blue and red phosphors it is possible to prevent decrease in the brightness caused by the admixture of the red and blue pigments with a phosphor layer of the other color which has been inevitable in the prior art pigmented phosphors. For example, decrease in the brightness caused by invasion of red pigment particles into a blue phosphor layer can be efficiently prevented. Furthermore, as a not pigmented green phosphor layer is formed at the last, there is no fear of invasion of the pigment into the green phosphor layer.

EXAMPLE 3

A blue phosphor suspension was prepared containing 30% by weight of blue phosphor, 1.5% by weight of cobalt violet, 2.2% by weight of polyvinyl alcohol, 0.2% by weight of ammonium bichromate, 0.1% by weight of a surfactant and 66% by weight of water. The suspension was coated on the inner surface of a panel and dried. Then the dried film was exposed to ultraviolet rays through a shadow mask and not exposed portions were dissolved off by warm water developing technique to obtain a blue phosphor layer containing a purple pigment.

Thereafter, in the same manner a red phosphor layer containing the purple pigment and a green phosphor layer not containing any pigment were formed.

A color picture tube obtained by the method described above had much higher contrast than a tube not using any pigment. This method is characterized in that use of a purple pigment enables one to admix filter substances of two colors with blue and red phosphor layers which has heretofore been considered impossible, whereby color picture tubes utilizing filter substances can be manufactured with a lesser number of steps and at a lower cost than the prior art method.

As disclosed in Japanese Preliminary Publication of Patent Specification No. 126861/1977 published on Nov. 6, 1978 and corresponding to U.S. Pat. No. 4,273,842 issued on June 16, 1981 it is also possible to coat a photosensitive resin containing a diazonium salt as a major ingredient onto the inner surface of the panel, to expose to light portions of the resulting film on which a phosphor is to be coated later to convert the exposed portions by a photo-reaction and the moisture in the atmosphere into an adhesive substance and to apply phosphor layers and filter substances to desired portions by using the adhesiveness.

EXAMPLE 4

A photosensitve aqueous solution of a composition consisting of 0.6% by weight of arginic propylene glycol ester, 8.0% by weight of p-N.N dimethyl amino benzene diazonium zinc chloride, 0.003% by weight of Pluronic L92 (trade name) and the balance of water was uniformly coated on the inner surface of the panel to a thickness of 0.6 through 1.0 micron. Thereafter a shadow mask was combined with a panel and portions of the coated film to be applied with a blue phosphor later was exposed to light through the shadow mask. The diazonium salt at the exposed portions of the coated film was decomposed and the zinc chloride absorbs moisture in the atmosphere to become adhesive. Then a blue phosphor powder admixed with cobalt violet, i.e., a purple pigment, was blasted with air. The blue phosphor and the purple pigment adhere to exposed film which became adhesive. Following such exposure to light and phosphor blasting, a red phosphor admixed with a purple pigment, and a green phosphor not containing any pigment were sequentially applied to form three color phosphor layers on the inner surface of a panel. The resulting color picture tube had a much higher contrast than a color picture tube not using any pigment.

Although in the foregoing embodiments the filter substance (pigment) according to this invention was applied to red and blue phosphor layers, it should be understood that the filter substance of the invention can be applied to either one of the red and blue phosphor layers.

As above described, according to this invention it is possible to greatly improve the contrast of color picture tubes and to decrease the number of manufacturng steps thereof.

What is claimed is:

1. A color picture tube provided with a three color fluorescent screen comprising phosphors applied to predeteremined portions of an inner surface of a panel of said tube for emitting red, green and blue color lights, and a filter substance selectively located to be operative with each one of said red and blue phosphors and coated on the inner surface of said panel, said filter substance having a color different from colors of lights emitted by said red or blue phosphors.

2. The color picture tube according to claim 1, wherein said filter substance has a reflection ratio at about 450 nm and 620 nm, which is twice its ratio at about 550 nm.

3. The color picture tube according to claim 1 wherein said filter substance is selected from a group consisting of a purple pigment.

* * * * *

UNITED STATES PATENT AND TRADEMARK OFFICE

CERTIFICATE OF CORRECTION

PATENT NO. : 4,425,528

DATED : Jan. 10, 1984

INVENTOR(S) : Naomitsu Watanabe

It is certified that error appears in the above-identified patent and that said Letters Patent is hereby corrected as shown below:

Col. 1, line 32: change "used a mixture" to --used is a mixture--.

Col. 2, line 30: change "curve a shows" to --curve a shows--.

Col. 2, line 32: change "and curve b" to --and curve b--.

Col. 2, line 49: change "c shows" to --c shows--.

Col. 2, line 50: change "curve d" to --curve d--.

Col.4, line 35: Change "curve e" to --curve e--.

Col. 4, line 37: change "curve f" to --curve f--.

Col. 4, line 55 change "exposed portios" to --exposed portions--.

Signed and Sealed this

*Eighth* Day of *January 1985*

[SEAL]

*Attest:*

*Attesting Officer*

GERALD J. MOSSINGHOFF

*Commissioner of Patents and Trademarks*